United States Patent [19]

Atkins

[11] 4,143,237

[45] Mar. 6, 1979

[54] ELECTRICAL WIRE CONNECTOR

[76] Inventor: Geoff C. Atkins, 55315 McKenzie Hwy., Blue River, Oreg. 97413

[21] Appl. No.: 880,999

[22] Filed: Feb. 24, 1978

[51] Int. Cl.[2] ..... H01R 5/02

[52] U.S. Cl. ..... 174/87; 339/95 R

[58] Field of Search ..... 174/87; 339/95 R, 95 D, 339/98, 176 R, 176 M, 192 R, 256 R, 256 S, 258 R, 150 T, 198 E, 183, 193 R

[56] References Cited

U.S. PATENT DOCUMENTS

| | | | |
|---|---|---|---|
| 2,917,724 | 12/1959 | Jackson | 339/198 E |
| 3,437,981 | 4/1969 | Keller | 174/87 X |

*Primary Examiner*—Thomas J. Kozma

*Attorney, Agent, or Firm*—James D. Givnan, Jr.

[57] ABSTRACT

A connector for two or more electrical wires and having a multitude of wire receiving sockets each having a concealed metal sleeve therein to receive and hold an inserted wire end. A wire locking arrangement prevents accidental wire extraction. Each sleeve is capable of receiving different gauges of wire to permit connector use with wires of two or more gauges.

6 Claims, 5 Drawing Figures

ELECTRICAL WIRE CONNECTOR

BACKGROUND OF THE INVENTION

The present invention relates generally to electrical connectors for interconnecting the ends of electrical wires.

In common use are wire connectors which may be twisted into engagement with stripped wire ends. Typically such connectors include a helical wire component which progressively engages the wire ends. The wire ends themselves are usually wound about one another prior to applying the connector. A drawback to such connectors is their susceptibility to poor installation and to become dislodged from the joined wire ends along with their limited wire receiving capability.

Other types of electrical connectors require special tools for wire attachment and hence are not widely used by those having to make repeated connections of wires of different or the same gauge such as an electrician in the wiring of a house of building.

SUMMARY OF THE PRESENT INVENTION

The present invention is embodied in an electrical wire connector having a plurality of sockets into which the stripped wire ends are lockably inserted.

The present connector includes a dielectric body within which are a number of metallic sockets in conductive relationship with one another and all insulated from the connector exterior. A skirt portion of the shell projects an adequate distance to isolate any stripped wire segments from accidental contact with a foreign object. Each socket is formed along an arm which arm includes locking means to prevent wire extraction.

Objects of the present invention include the provision of an electrical connector for interconnecting the ends of two or more wire conductors which may be of different gauge; the provision of an electrical connector including means for locking inserted wire ends against extraction; the provision of an electrical connector requiring only stripping of wire ends before connector attachment, and; the provision of an electrical connector having flexible socket components to accept different size wire ends.

BRIEF DESCRIPTION OF THE DRAWING

In the accompanying drawing.

DETAILED DESCRIPTION OF THE PREFERRED EMBODIMENT

Figure 1:
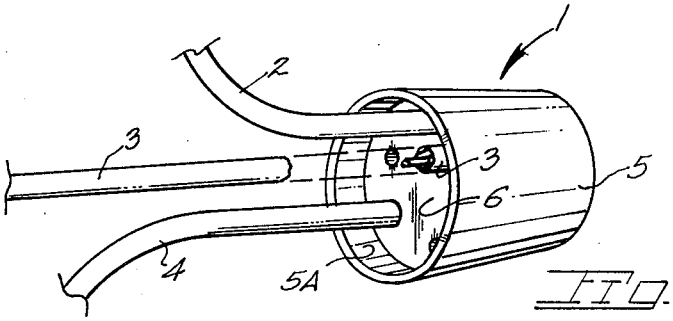
FIG. 1 is a perspective view of the present connector.
Figure 2:
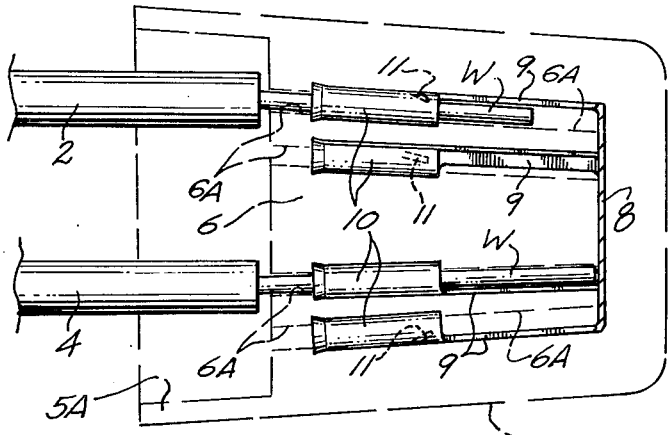
FIG. 2 is a vertical sectional view of the conductive member taken along a vertical centerline of the connector with remaining connector components shown in phantom lines.
Figure 3:
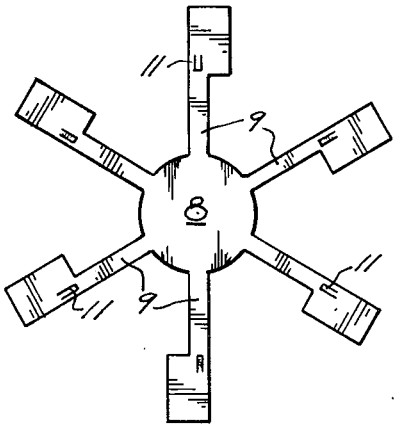
FIG. 3 is a plan view of the conductive member prior to completion of its forming.
Figure 4:
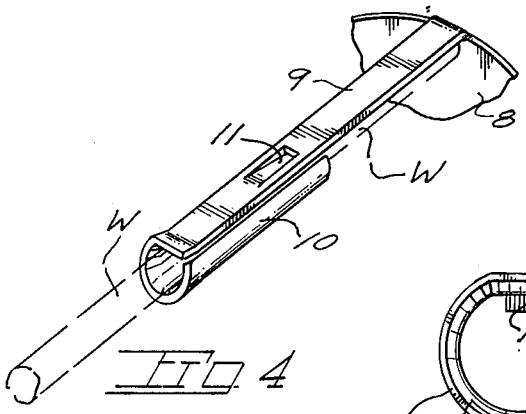
FIG. 4 is a fragmentary perspective view of a single socket of the connector.

With continuing attention to the drawing, the reference numeral 1 indicates generally the present connector, shown in FIG. 1, in operative attachment with the ends of insulated electrical wires 2, 3 and 4.

The connector comprises an exterior component at 5 having a skirt portion 5A. Said shell is of a dielectric material such as a durable synthetic resin of the type presently used in the known connectors earlier mentioned. A dielectric mass at 6 defines openings at 6A to receive the inserted wire ends.

Indicated at 8 is a conductive member of the connector having a base from which extend multiple arms 9. Each arm 9 is integral with the base and, at its opposite end, includes a sleeve 10 formed from a widened arm end segment.

Figure 5:
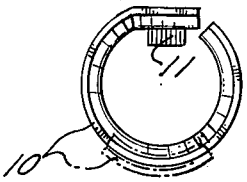
FIG. 5 is an end view of a socket with a flexed sleeve position shown in broken lines.

A tab 11 is struck from each sleeve so as to have its distal end directed toward the base 8 of the conductive member and thereby providing locking means on each sleeve engageable with an inserted wire end at W. Said locking means is of a resilient nature so as to flexibly receive the wire but resist wire retraction in an opposite direction. Each sleeve 10 is of a size to receive an inserted wire end and preferably may flex radially per FIG. 5 to accept more than one gauge of wire end W. The tab 11 is preferably formed on the rigid portion of the sleeve i.e., that portion aligned with arm 9, for purposes of secure tab-wire engagement. Sleeve 10 may be flared.

In forming of the connector, the conductive member 8 may be coupled to sleeve occupying wires of a harness to resist tab embedment enabling wire removal from sockets 6A upon completion of connector manufacture.

In use, a wire end is stripped and inserted the full length of socket 6A past a sleeve 10 therein. The tab 11 flexes to admit the wire end and thereafter seats firmly against the wire surface to prevent wire extraction. The number of sockets per connector may vary as may the socket and sleeve dimensions to best suit the use to which the connector is to be put.

While I have shown but one embodiment of the invention it will be apparent to those skilled in the art that the invention may be embodied still otherwise without departing from the spirit and scope of the invention.

Having thus described the invention, what is claimed and desired to be secured under a Letters Patent is:

1. A connector for two or more electrical wires, said connector comprising, a dielectric mass defining a multitude of sockets, a conductive member within said mass and having a plurality of wire receiving sleeves, said sleeves one each substantially concentric with one each of said sockets and inset from an exposed surface of said dielectric mass, and an outer skirt portion of said dielectric mass extending outwardly beyond said exposed surface thereof.

2. The connector claimed in claim 1 wherein said conductive member additionally includes wire engaging locking means.

3. The connector claimed in claim 2 wherein said locking means is a flexible tab integral with a sleeve.

4. The connector claimed in claim 3 wherein each of said sleeves is adapted to flex radially to receive wire ends of different gauge.

5. The connector claimed in claim 4 wherein said conductive member includes a common base against which inserted wires may abut to limit wire insertion.

6. The Connector claimed in claim 5 wherein each sleeve is flared at its wire receiving end.

* * * * *